US007738820B2

(12) United States Patent
Law et al.

(10) Patent No.: US 7,738,820 B2
(45) Date of Patent: Jun. 15, 2010

(54) HSD WIRES USING FIBROUS CARBON NANOMATERIAL YARNS

(75) Inventors: Kock-yee Law, Penfield, NY (US); Eric M. Gross, Brighton, NY (US); Mark J. Hirsch, Fairport, NY (US); Gregory C. Brockway, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 234 days.

(21) Appl. No.: 12/100,007

(22) Filed: Apr. 9, 2008

(65) Prior Publication Data

US 2009/0257787 A1 Oct. 15, 2009

(51) Int. Cl.
*G03G 15/08* (2006.01)

(52) U.S. Cl. ..... 399/266

(58) Field of Classification Search ..... 399/266, 399/290, 291; 428/323, 368; 427/385.5; 977/750, 742, 752

See application file for complete search history.

(56) References Cited

U.S. PATENT DOCUMENTS

| | | | | |
|---|---|---|---|---|
| 5,031,570 | A | 7/1991 | Hays et al. | |
| 7,356,296 | B2 * | 4/2008 | Ito | 399/303 |
| 2005/0170089 | A1 | 8/2005 | Lashmore et al. | |
| 2007/0036709 | A1 | 2/2007 | Lashmore et al. | |
| 2008/0014431 | A1 | 1/2008 | Lashmore et al. | |

* cited by examiner

*Primary Examiner*—David P Porta
*Assistant Examiner*—Kiho Kim
(74) *Attorney, Agent, or Firm*—Oliff & Berridge, PLC

(57) ABSTRACT

A Hybrid Scavengeless Development electrophotographic printing system is provided wherein the electrode wires contain carbon nanotube yarn. The use of carbon nanotube yarn alleviates the problem of fundamental strobing image defects, because the electrodes made from the carbon nanotube yarn can be put at a higher tension to density set point, and thereby achieve fundamental resonance frequencies larger than that obtainable from steel. Additionally the yarn's strength is sufficient to withstand the typical forces it is subjected to in a Hybrid Scavengeless Development environment.

18 Claims, 2 Drawing Sheets

HSD WIRES USING FIBROUS CARBON NANOMATERIAL YARNS

FIELD OF THE INVENTION

This invention relates to the field of electrophotographic image forming systems, specifically to the material used as the electrode wires in Hybrid Scavengeless Development systems.

BACKGROUND

Hybrid Scavengeless Development (HSD) is a process for electrophotographic imaging and printing apparatuses designed to prevent scavenging of toner from the photoreceptor of the imaging device by subsequent development stations.

In general, the process of electrophotographic printing includes charging a photoconductive member to a substantially uniform potential to sensitize the surface. The charged photoconductive surface is exposed to a light image from either a scanning laser beam, an LED source, or an original document being reproduced. This records an electrostatic latent image on the photoconductive surface. After the electrostatic latent image is recorded on the photoconductive surface, the latent image is developed. Two-component and single-component developer materials are commonly used for development. A typical two-component developer comprises magnetic carrier granules having toner particles adhering triboelectrically thereto. A single-component developer material typically comprises toner particles. Toner particles are attracted to the latent image through electrostatic fields that impart forces to charged toner particles, forming a toner image on the photoconductive surface. The toner image is subsequently transferred to a final substrate such as paper. Finally, the toner powder image is heated to permanently fuse it to the final substrate.

The electrophotographic marking process discussed above can be modified to produce color images. One color electrophotographic marking process, called image-on-image (IOI) processing, superimposes toner powder images of different color toners onto the photoreceptor prior to the transfer of the composite toner powder image onto the substrate. While the IOI process provides certain benefits, such as a compact architecture, there are several challenges to its successful implementation. For instance, the viability of printing system concepts such as IOI processing requires development systems that do not interact with a previously toned image. Since several known development systems, such as conventional magnetic brush development and jumping single-component development, interact with the image on the receiver, a previously toned image will be scavenged by subsequent development if interacting development systems are used. Thus, for the IOI process, there is a need for scavengeless or non-interactive development systems. For a thorough description of scavengeless development see U.S. Pat. No. 5,031,570, hereby incorporated by reference in its entirety.

Hybrid Scavengeless Development technology deposits toner via a conventional magnetic brush onto the surface of a donor roll and a plurality of electrode wires are closely spaced from the toned donor roll in the development zone to the photoreceptor. An AC voltage is applied to the electrode wires to generate a toner cloud in the development zone. This is accomplished as a result of the toner layer on the donor roll being disturbed by electric fields from the wire or set of wires, which produce and sustain an agitated cloud of toner particles in the development nip. Toner from the cloud is then developed onto the nearby photoreceptor by fields created by a latent image.

A problem inherent to such developer systems using wires is vibration of the wires with respect to the donor roll and photoreceptor surfaces. This wire vibration manifests itself as a density variation of toner on the photoreceptor, referred to as "banding." This banding occurs at a frequency corresponding to the wire vibration frequency. Banding is highly undesirable, as it results in objectionable image quality defects.

The banding toner density variations and the wire vibrations that cause them are lumped together into a problem with the generic name of "strobing." More specifically, "fundamental strobing" is the term used to describe the vibration and print defect associated with the fundamental mode of vibration of the electrode wire. The frequency of the fundamental mode of vibration is given by the expression $$w_f = \sqrt{\frac{T}{4 * \rho * A * L^2}} \qquad \text{Equation 1}$$

wherein T is the wire tension, ρ is the wire density, A is the wire cross section, and L is the length of the wire. One way to minimize strobing is to make the frequency of the fundamental mode as high as possible, because banding at higher frequencies becomes progressively less visible to the naked human eye. Therefore, the tension T is set as high as possible constrained by wire breakage, the limit imposed by the material yield strength. So with a factor of safety $\alpha \leqq 1$, T can be set to $\alpha S_y A$, where $S_y$ is the yield strength. In this case, the frequency of the fundamental mode can be expressed as, $$W_f = \frac{1}{2L}\sqrt{\frac{\alpha S_y}{\rho}} \qquad \text{Equation 2}$$

Thus, for a given material, factor of safety, and process width, L, the maximum fundamental mode is proportional to the yield strength divided by the density.

Conventional Hybrid Scavengeless Development electrode wires are often made of stainless steel. For example, the electrode wires are commonly made of 304v stainless steel. Such conventional steel electrode wires exhibit a maximum fundamental resonance frequency in the range of approximately 550 Hz at the required length. This frequency results from steel having a tensile strength of 700 MPa and a density of 7.8 g/cm$^3$. Fundamental strobing is unfortunately visible to the naked human eye at this frequency. The fundamental vibration frequency cannot be further increased while using conventional steel electrodes because the innate physical properties of steel as a material are the limiting factor.

Therefore, there remains in the art a need for an improved HSD system that alleviates fundamental strobing.

SUMMARY

The present disclosure addresses these and other needs, by providing an improved Hybrid Scavengeless Development system. More particularly, this disclosure provides an improved Hybrid Scavengeless Development system wherein the electrode wires are made of fibrous carbon nanomaterials.

In embodiments, this disclosure provides a Hybrid Scavengeless Development electrophotographic printing system comprising wire electrodes, wherein the wire electrodes are comprised of fibrous carbon nanomaterials.

EMBODIMENTS

Figure 1:
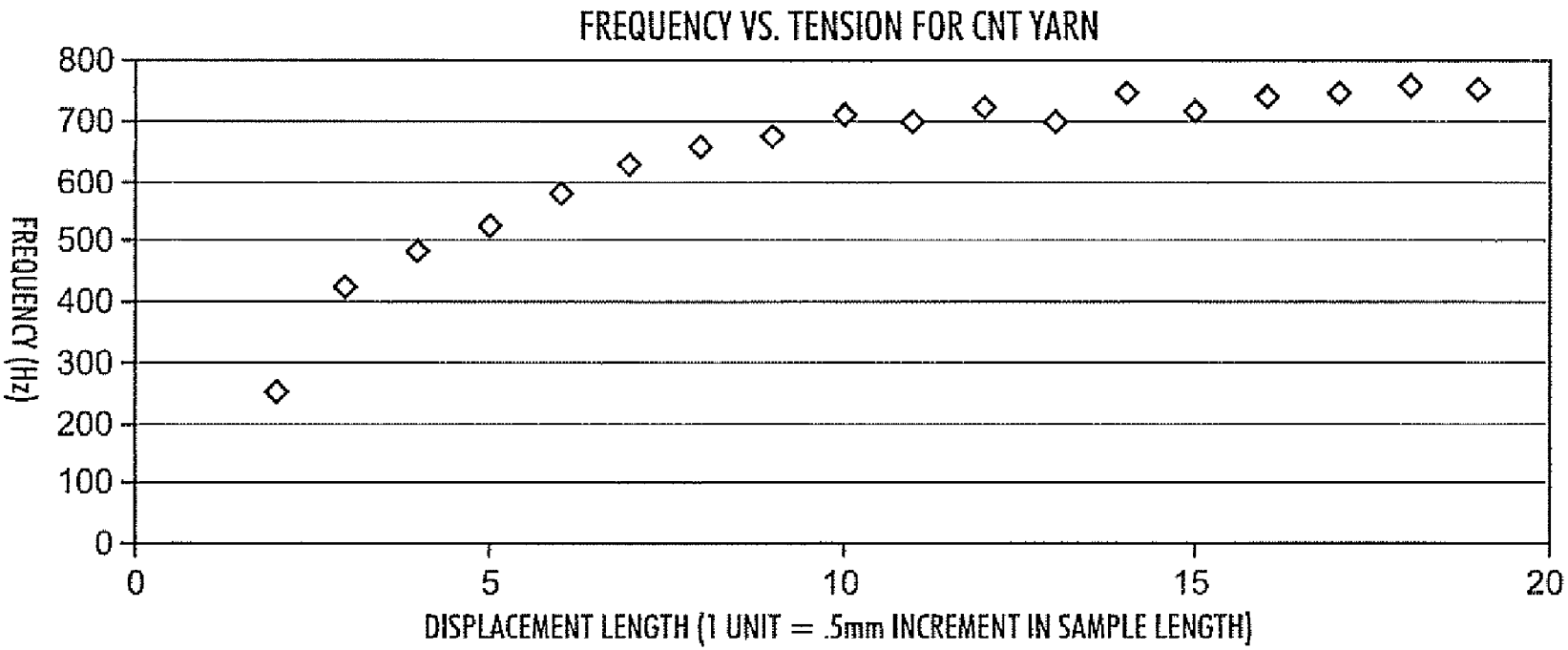
FIG. 1 shows a plot of fundamental resonance frequency of a carbon nanotube yarn as a function of tension.

This disclosure is not limited to particular embodiments described herein, and some components and processes may be varied by one of ordinary skill in the art, based on this disclosure. The terminology used herein is for the purpose of describing particular embodiments only, and is not intended to be limited.

In this specification and the claims that follow, singular forms such as "a," "an," and "the" include plural forms unless the content clearly dictates otherwise. In addition, reference may be made to a number of terms that shall be defined as follows:

The term "Hybrid Scavengeless Development system" is defined as an electrophotographic printing system wherein charged toner is deposited on a donor roll, and then the toner is agitated off of the donor roll by an electric field originating from wire electrodes such that the toner is subsequently developed onto a photoreceptor in the form of an image thereon.

The term "fibrous carbon nanomaterials" refers to any material in the shape of a fiber, in other words having continuous filaments or elongated pieces, made up of a carbon based nanomaterial. Carbon based nanomaterials include, for example, carbon nanotubes, as well as other carbon allotropes such as graphene ribbon or carbon fiber.

An improved Hybrid Scavengeless Development system wherein the wire electrodes comprise a yarn comprised of fibrous carbon nanomaterials is provided.

As an example of a fibrous carbon nanomaterial, carbon nanotube yarn is a textile formed from long carbon nanotubes. Carbon nanotubes are, as is generally known, cylindrical shaped fullerene allotropes of carbon. Carbon nanotube yarn is formed by wrapping many individual carbon nanotubes into a continuous textile. Specifically, carbon nanotubes are first formed through a process such as chemical vapor deposition in the presence of a catalyst, as is described in U.S. Patent Application Publication No. 2005/0170089 to Lashmore et al., which is hereby incorporated by reference in its entirety. Next, the individual carbon nanotubes can be formed into a yarn through a spinning process, as is described in U.S. Patent Application Publication No. 2007/0036709 to Lashmore et al., which is hereby incorporated by reference in its entirety. Finally, the carbon nanotube yarn can undergo a post-synthesis treatment in order to align the carbon nanotubes in a substantially parallel orientation, in order to enhance the mechanical and electrical properties, as is also described in U.S. Patent Application Publication No. 2007/0036709 to Lashmore et al. Further carbon nanotube yarn synthesis processes are described in U.S. Patent Application Publication No. 2008/0014431 to Lashmore et al., which is hereby incorporated by reference in its entirety.

In embodiments, the carbon nanotube yarn is obtained from Nanocomp Technologies Inc.

The carbon nanotubes which make up the carbon nanotube yarn may be single walled, double walled, multi-walled or mixtures thereof. In embodiments, the carbon nanotubes may have diameters ranging from about 0.5 nm to about 20 nm, and may have lengths ranging from about 200 nm to about 1 cm.

In embodiments, the fibrous carbon nanomaterials posses certain physical properties that make it advantageous for use as a wire electrode in Hybrid Scavengeless Development printing systems. First, for example, the tensile strength of carbon nanotube yarn is, in embodiments, stronger than stainless steel. The tensile strength can be, for example, greater than 800 MPa. Currently, carbon nanotube yarns can possess tensile strengths of up to about 3 GPa. Advances in the process by which the carbon nanotube yarn is produced are expected to result in carbon nanotube yarns having tensile strengths of up to about 6 GPa.

Other advantageous physical properties of the fibrous carbon nanomaterials include the low density. In embodiments, for example, the density of carbon nanotube yarn can be less than that of steel, in other words less than about 7.8 g/cm$^3$, for example less than about 1.4 g/cm$^3$. In particular, the density of carbon nanotube yarn can be less than about 0.4 g/cm$^3$, such as from about 0.2 g/cm$^3$ to about 0.3 g/cm$^3$.

As the square of the maximum fundamental resonance frequency is inversely proportional to the density and proportional to tensile strength, as shown in the equations above, the low density and high tensile strength make carbon nanotube yarn appropriate for use as Hybrid Scavengeless Development system wire electrodes. Specifically, as a result of the advantageous physical properties of the carbon nanotube yarn, Hybrid Scavengeless Development system wire electrodes made up of carbon nanotube yarn can result in advantageous print clarity. In particular, carbon nanotube yarn wire electrodes can be configured such that little or no strobing is visible on a resulting printed image.

For example, for an equivalent length of the electrode, the frequency of the fundamental mode of the electrode comprising carbon nanotube yarn is higher than the frequency of the fundamental mode of an electrode made from stainless steel. In embodiments with a wire length of about 400 mm, the maximum frequency of the fundamental mode of the electrode comprising carbon nanotube yarn has a value that is greater than about 750 Hz. In particular embodiments, as the tensile strength of the carbon nanotube yarn increases, the maximum frequency of the fundamental mode of the yarn can be from about 750 Hz to about 2,000 Hz.

As shown in FIG. 1, the frequency of fundamental resonance was tested for carbon nanotube yarn as a measure of tension. The tension is shown in 0.5 mm displacement length increments, and was steadily increased until breakage. With knowledge of the yield strength, at an ~0.8 factor of safety the frequency of fundamental resonance was found to be approximately 750 Hz for a 40 cm length equivalent. As compared to conventional steel wires, having a frequency of the fundamental mode of 550 Hz at an equivalent length, the carbon nanotube yarn therefore provides an approximately 35% advantage. As the particular carbon nanotube yarn tested was merely one example, higher maximum frequencies of the fundamental mode can be achieved by carbon nanotube yarns having proportionally higher tensile strengths. This increased maximum fundamental resonance frequency thereby decreases the adverse impact of fundamental strobing.

In addition to decreasing fundamental strobing for a given print format, this decrease in fundamental strobing also allows Hybrid Scavengeless Development systems to be used where fundamental strobing would otherwise result in prohibitive levels of image defects, such as in wide format development. As shown in Equation 2, the fundamental frequency is inversely proportional to the length of the electrode. In other words, for a given amount of tension, the fundamental frequency will reduce as the length of the electrode is increased. Therefore, because the length of the electrode scales with the width of the printing process, wide format printing using conventional stainless steel electrodes would result in unacceptable visible banding because the frequency of the fundamental mode is too low. On the other hand, carbon nanotube yarns can enable wider format printing if the frequency of the fundamental mode is so much higher that any decrease in the frequency of the fundamental mode, as a result of a longer electrode, still does not result in excess visible banding. Therefore, the electrode made from the carbon nanotube yarn can have a length of from about 30 cm to about 1 m. Accordingly, a wide format printer with width exceeding 400 mm can be made using carbon nanotube yarns as the electrodes.

A high tensile strength also allows carbon nanotube yarns to be used as Hybrid Scavengeless Development system electrode wires wherein the wire has a smaller diameter than conventional Hybrid Scavengeless Development system electrode wires made of steel. Conventional steel wires are generally 50 microns in diameter. However, wires made of carbon nanotube yarns can be as small as 10 microns in diameter. Although, generally, the carbon nanotube yarn can have a diameter of between about 10 microns to about 100 microns.

Smaller diameter wires can have stronger electric fields at their surface due to the smaller radius of curvature. Thus, development efficiency can be increased. These higher electric fields at the wire surface will also be more efficient at expelling contamination which would otherwise result in image quality defects, such as streaks. For example, contamination in the form of small charged particles which have been observed to adhere to the surfaces of 50 um steel wires. Smaller diameter is hypothesized to reduce contamination because there is less surface area to which the toner particles may adhere, and the electric fields at the surface are stronger, preventing the buildup of contaminants.

Additionally, a practical limit to using smaller diameter stainless steel wire is the low breaking strength of such wires having diameters of less than about 50 microns. Conventional handling procedures are not gentle enough to reliably use such stainless steel wires. The higher tensile strength of a similar diameter carbon nanotube yarn will make it more robust to mechanical handling.

Furthermore, the high tensile strength and low density of carbon nanotube yarn are not the only properties that make it appropriate for use as Hybrid Scavengeless Development system electrode wires. Carbon nanotube yarn also posses excellent electrical conductivity. Specifically, carbon nanotube yarns have a resistivity value of from about $1*10^{-4}$ Ω-cm to about $4*10^{-4}$ Ω-cm. Therefore, carbon nanotube yarns are well suited to act as an electrode. In this way, it is clear that a high tensile strength is not the only required characteristic for a material to act as a Hybrid Scavengeless Development system electrode wire, but that carbon nanotube yarns unexpectedly provide a variety of highly desirable physical characteristics.

Figure 2:
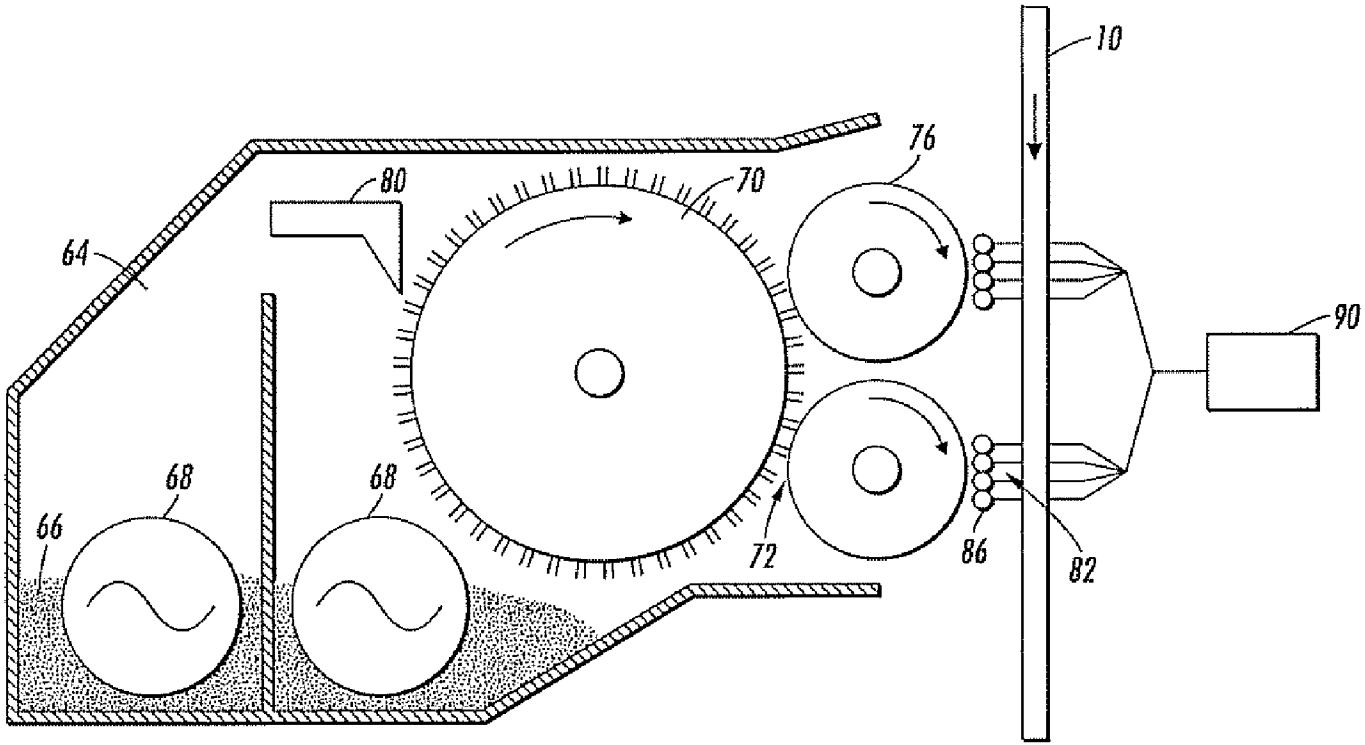
FIG. 2 shows an exemplary Hybrid Scavengeless Development system.

FIG. 2 shows an example of a Hybrid Scavengeless Development development system. The development apparatus comprises a reservoir 64 containing developer material 66. The developer material 66 is of the two component type, it comprises carrier granules and toner particles. The reservoir includes augers, indicated at 68, which are rotatably-mounted in the reservoir chamber. The augers 68 serve to transport and to agitate the material within the reservoir and encourage the toner particles to adhere triboelectrically to the carrier granules.

A magnetic brush roll 70 transports developer material from the reservoir to the loading nips 72 of two donor rolls 76. Magnetic brush rolls are well known, so the construction of roll 70 need not be described in great detail. Briefly, the roll comprises a rotatable tubular housing within which is located a stationary magnetic cylinder having a plurality of magnetic poles impressed around its surface. The carrier granules of the developer material are magnetic and, as the tubular housing of the roll 70 rotates, the granules (with toner particles adhering triboelectrically thereto) are attracted to the roll 70 and are conveyed to the donor roll loading nips 72. A metering blade 80 removes excess developer material from the magnetic brush roll and ensures an even depth of coverage with developer material before arrival at the first donor roll loading nip 72.

At each of the donor roll loading nips 72, toner particles are transferred from the magnetic brush roll 70 to the respective donor roll 76. Each donor roll transports the toner to a the development zone 82 through which the photoconductive belt 10 passes. Transfer of toner from the magnetic brush roll 70 to the donor rolls 76 is encouraged by, for example, the application of a suitable D.C. electrical bias to the magnetic brush and/or donor rolls. The D.C. bias (for example, approximately 100 v applied to the magnetic roll) establishes an electrostatic field between the donor roll and magnetic brush rolls, which causes toner particles to be attracted to the donor roll from the carrier granules on the magnetic roll. The carrier granules and any toner particles that remain on the magnetic brush roll 70 are returned to the reservoir 64 as the magnetic brush continues to rotate. The relative amounts of toner transferred from the magnetic roll 70 to the donor rolls 76 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At the development zone 82, toner is transferred from the respective donor roll 76 to the latent image on the belt 10 to form a toner powder image on the latter. The toner is transferred according to the Hybrid Scavengeless system, as now hereinafter described.

Electrode wires are disposed in the space between each donor roll 76 and the belt 10. For each donor roll 76, four electrode wires 86 extend in a direction substantially parallel to the longitudinal axis of the donor roll. The electrode wires are made from the carbon nanotube yarn, described above. The distance between each wire and the respective donor roll is within the range from about 10 μm to about 50 μm (typically approximately 25 μm) or the thickness of the toner layer on the donor roll. The wires are self-spaced from the donor rolls by the thickness of the toner on the donor rolls. To this end the extremities of the wires are supported by the tops of end bearing blocks that also support the donor rolls for rotation. The wire extremities are attached so that they are slightly above a tangent to the surface, including the toner layer, of the donor roll structure.

An alternating electrical bias is applied to the electrode wires by an AC voltage source 90. The applied AC establishes an alternating electrostatic field between each wire and the respective donor roll, which is effective in detaching toner from the surface of the donor roll and forming a toner cloud about the wires, the height of the cloud being such as not to be substantially in contact with the belt 10. The magnitude of the AC voltage is in the order of 200 to 500 volts peak at a frequency ranging from about 3 kHz to about 18 kHz. A DC bias supply (not shown) applied to each donor roll 76 establishes electrostatic fields between the belt 10 and donor rolls for attracting the detached toner particles from the clouds surrounding the wires to the latent image recorded on the photoconductive surface of the belt. At a spacing ranging from about 10 μm to about 50 μm between the electrode wires and donor rolls, an applied voltage of 200 to 500 volts produces a relatively large electrostatic field without risk of air breakdown. The use of a dielectric coating on either the electrode wires or donor roller helps to prevent shorting of the applied AC voltage.

The donor rolls 76 and the magnetic brush roll 70 can be rotated either "with" or "against" the direction of motion of the belt 10.

The two-component developer 66 may be of any suitable type. However, the use of an electrically-conductive developer is preferred because it facilitates the efficient loading of toner from the magnetic brush to the donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 92% to about 98% by weight of carrier and from 2% to about 8% by weight of toner.

EXAMPLES

The disclosure will be illustrated in greater detail with reference to the following examples, but the disclosure should not be construed as being limited thereto. In the following examples, all the "parts" are given by weight unless otherwise indicated.

Example 1

A Hybrid Scavengeless Development (HSD) wire module containing carbon nanotube yarns was fabricated by mounting 8 carbon nanotube yarns, of diameter about 70 micron, from Nanocomp on the standard iGen 3 HSD wire module.

The yarn had a length of about 440 mm. The wire module was mounted on an offline development test fixture. The developability of the wire module was tested by measuring the development mass. Using cyan toner at a Toner Concentration of approximately 5%, a mag roll DC voltage of 100V, mag roll AC of 200V, donor roll DC voltage of 30V, donor roll AC voltage of 100V, and wire AC voltage of about 750V, the development mass for a solid area patch was determined to be approximately 0.5 mg/cm$^2$. These conditions are comparable to those in which the standard 8 stainless steel wire module is utilized. Prints were produced and it was confirmed that the appropriate mass levels were achievable.

Example 2

The fundamental frequency produced by the carbon nanotube yarns was tested on an offline fixture where the tension to the wire is increased systematically by increasing the displacement setting (0.5 mm at a time). For the carbon nanotube yarn, the frequency increases to approximately 750 Hz with a 5 mm displacement length. For the standard stainless steel wire, the frequency only achieves 650 Hz before the wires are broken.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A Hybrid Scavengeless Development electrophotographic printing system comprising wire electrodes, wherein the wire electrodes comprise a yarn comprised of fibrous carbon nanomaterials.

2. The Hybrid Scavengeless Development electrophotographic printing system of claim 1, wherein the fibrous carbon nanomaterials are comprised of carbon nanotubes.

3. The Hybrid Scavengeless Development electrophotographic printing system of claim 2, wherein the carbon nanotubes are selected from the group consisting of single walled carbon nanotubes, double walled carbon nanotubes, multiwalled carbon nanotubes, and mixtures thereof.

4. The Hybrid Scavengeless Development electrophotographic printing system of claim 2, wherein the carbon nanotubes have a diameter of from about 0.5 nm to about 20 nm.

5. The Hybrid Scavengeless Development electrophotographic printing system of claim 2, wherein the carbon nanotubes have a length of from about 200 nm to about 1 cm.

6. The Hybrid Scavengeless Development electrophotographic printing system of claim 2, wherein the fibrous carbon nanomaterials are made by a chemical vapor deposition process followed by spinning the carbon nanotubes into yarns.

7. The Hybrid Scavengeless Development electrophotographic printing system of claim 2, wherein the fibrous carbon nanomaterials undergo a post-synthesis treatment to align the carbon nanotubes in a substantially parallel orientation.

8. The Hybrid Scavengeless Development electrophotographic printing system of claim 1, wherein the yarn has a tensile strength of greater than about 800 MPa.

9. The Hybrid Scavengeless Development electrophotographic printing system of claim 8, wherein the yarn has a tensile strength of between about 1 GPa and 6 GPa.

10. The Hybrid Scavengeless Development electrophotographic printing system of claim 1, wherein the yarn has a diameter in the range of from about 10 microns to about 100 microns.

11. The Hybrid Scavengeless Development electrophotographic printing system of claim 1, wherein the yarn has a length of from about 30 cm to about 1 m.

12. The Hybrid Scavengeless Development electrophotographic printing system of claim 6, wherein the fundamental mode of the yarn, having a length of about 400 mm, has a value from about 750 Hz to about 2000 Hz.

13. The Hybrid Scavengeless Development electrophotographic printing system of claim 1, wherein the fundamental mode of the yarn, having a length of about 400 mm, has a value of greater than about 750 Hz.

14. The Hybrid Scavengeless Development electrophotographic printing system of claim 1, wherein the yarn has a density value of less than about 1.4 g/cm$^3$.

15. The Hybrid Scavengeless Development electrophotographic printing system of claim 1, wherein the yarn has a density value of less than about 0.4 g/cm$^3$.

16. The Hybrid Scavengeless Development electrophotographic printing system of claim 1, wherein the yarn has a resistivity value of from about $1*10^{-4}$ Ω-cm to about $4*10^{-4}$ Ω-cm.

17. The Hybrid Scavengeless Development electrophotographic printing system of claim 1, wherein printing system is a wide format printer with width greater than 400 mm.

18. An apparatus for developing latent electrostatic images with toner comprising: a charge retentive surface; a supply of two-component developer including toner and carrier beads; a developer transport structure spaced from said charge retentive surface for conveying developer from said supply of developer to an area opposite said charge retentive surface without contacting said surface; an electrode structure; an AC power source for establishing an alternating electrostatic field between said developer transport structure and said electrode structure for creating a cloud of toner proximate said electrode structure; wherein said electrode structure comprises a plurality of yarns comprised of fibrous carbon nanomaterial comprising carbon nanotubes, operatively connected to an AC power source and being positioned in a space between said charge retentive surface and developer transport structure; and a power source for creating an electrostatic field between said charge retentive surface and said electrode structure for effecting movement of toner from said cloud of toner to said latent electrostatic images.

* * * * *